US011600430B2

(12) United States Patent
Jang et al.

(10) Patent No.: US 11,600,430 B2
(45) Date of Patent: Mar. 7, 2023

(54) INDUCTOR INCLUDING HIGH-RIGIDITY INSULATING LAYERS

(71) Applicant: SAMSUNG ELECTRO-MECHANICS CO., LTD., Suwon-si (KR)

(72) Inventors: Jong Yoon Jang, Suwon-si (KR); Seok Hwan Ahn, Suwon-si (KR); Jeong Min Cho, Suwon-si (KR); Tae Hoon Kim, Suwon-si (KR); Jin Gul Hyun, Suwon-si (KR); Se Woong Paeng, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 60 days.

(21) Appl. No.: 16/984,590

(22) Filed: Aug. 4, 2020

(65) Prior Publication Data

US 2020/0365313 A1 Nov. 19, 2020

Related U.S. Application Data

(62) Division of application No. 15/677,923, filed on Aug. 15, 2017, now Pat. No. 10,763,031.

(30) Foreign Application Priority Data

Aug. 30, 2016 (KR) ..... 10-2016-0110571
Jan. 19, 2017 (KR) ..... 10-2017-0009248

(51) Int. Cl.
*H01F 27/00* (2006.01)
*H01F 27/28* (2006.01)
(Continued)

(52) U.S. Cl.
CPC ..... *H01F 27/2804* (2013.01); *H01F 17/0013* (2013.01); *H01F 27/292* (2013.01);
(Continued)

(58) Field of Classification Search
CPC ..... H01F 17/0013; H01F 27/2804; H01F 27/292; H01F 41/042; H01F 41/041; H01F 41/122
See application file for complete search history.

(56) References Cited

U.S. PATENT DOCUMENTS 6,165,866 A 12/2000 Kobayashi
6,489,877 B1 12/2002 Yamamoto et al.
(Continued)

FOREIGN PATENT DOCUMENTS

CN 1220474 A 6/1999
CN 1296271 A 5/2001
(Continued)

OTHER PUBLICATIONS

Office Action issued in Chinese Patent Application No. 201710754741.2 dated Jul. 3, 2019, (with English translation).
(Continued)

*Primary Examiner* — Paul D Kim
(74) *Attorney, Agent, or Firm* — Morgan, Lewis & Bockius LLP

(57) ABSTRACT

There are provided an inductor and a method of manufacturing the same. The inductor includes: a body including a plurality of coil layers and high-rigidity insulating layers disposed on and beneath the plurality of coil layers; and external electrodes disposed on external surfaces of the body and connected to the coil layers. Build-up insulating layers are disposed between the high-rigidity insulating layers to
(Continued)

cover the coil layers, and the high-rigidity insulating layers have a Young's modulus greater than that of the build-up insulating layers.

5 Claims, 7 Drawing Sheets

(51) Int. Cl.

| | |
|---|---|
| ***H01F 17/00*** | (2006.01) |
| ***H01F 41/04*** | (2006.01) |
| ***H01F 27/32*** | (2006.01) |
| ***H01F 27/29*** | (2006.01) |
| ***H01F 41/12*** | (2006.01) |

(52) U.S. Cl.
CPC ..... *H01F 27/32* (2013.01); *H01F 41/041* (2013.01); *H01F 41/042* (2013.01); *H01F 41/122* (2013.01); *H01F 2027/2809* (2013.01)

(56) References Cited

U.S. PATENT DOCUMENTS

| | | | | |
|---|---|---|---|---|
| 7,937,828 | B2 * | 5/2011 | Yamano | H01L 23/5389 174/262 |
| 8,785,786 | B2 | 7/2014 | Yamada | |
| 9,253,877 | B2 | 2/2016 | Sato | |
| 9,478,354 | B2 | 10/2016 | Suzuki | |
| 2001/0008794 | A1 | 7/2001 | Akagawa | |
| 2003/0213615 | A1 | 11/2003 | Utsumi et al. | |
| 2004/0027770 | A1 | 2/2004 | Yamamoto et al. | |
| 2004/0108934 | A1 | 6/2004 | Choi et al. | |
| 2007/0044303 | A1 | 3/2007 | Yamano | |
| 2007/0184251 | A1 | 8/2007 | Chikagawa | |
| 2008/0142147 | A1 | 6/2008 | Kawamura et al. | |
| 2008/0169542 | A1 | 7/2008 | Suzuki et al. | |
| 2009/0072404 | A1 | 3/2009 | Kikuchi et al. | |
| 2009/0283302 | A1 | 11/2009 | Lee et al. | |
| 2012/0152598 | A1 | 6/2012 | Yamada | |
| 2013/0160290 | A1 | 6/2013 | Maeda et al. | |
| 2013/0199830 | A1 | 8/2013 | Morita et al. | |
| 2013/0247373 | A1 | 9/2013 | Fujii et al. | |
| 2013/0249661 | A1 | 9/2013 | Motomiya et al. | |
| 2015/0073088 | A1 * | 3/2015 | Kim | C08J 3/20 524/605 |
| 2015/0102890 | A1 | 4/2015 | Nakamura et al. | |
| 2016/0225513 | A1 | 8/2016 | Park | |
| 2017/0287622 | A1 | 10/2017 | Ishizaki | |

FOREIGN PATENT DOCUMENTS

| | | | |
|---|---|---|---|
| CN | 1461183 | A | 12/2003 |
| CN | 1463470 | A | 12/2003 |
| CN | 1465131 | A | 12/2003 |
| CN | 1505068 | A | 6/2004 |
| CN | 1921079 | A | 2/2007 |
| CN | 101049058 | A | 10/2007 |
| CN | 101238570 | A | 8/2008 |
| CN | 101347058 | A | 1/2009 |
| CN | 101388373 | A | 3/2009 |
| CN | 101808477 | A | 8/2010 |
| CN | 103179811 | A | 6/2013 |
| CN | 104160792 | A | 11/2014 |
| CN | 104768320 | A | 7/2015 |
| CN | 104797093 | A | 7/2015 |
| JP | 2001-217550 | A | 8/2001 |
| JP | 2002-368524 | A | 12/2002 |
| JP | 2007-059821 | A | 3/2007 |
| JP | 2009-0278060 | A | 11/2009 |
| JP | 2012-069754 | A | 4/2012 |
| JP | 2014-036094 | A | 2/2014 |
| JP | 2015-076597 | A | 4/2015 |
| JP | 2015-084420 | A | 4/2015 |
| JP | 2017-183529 | A | 10/2017 |
| KR | 10-2016-0092290 | A | 8/2016 |
| WO | 02/084732 | A2 | 10/2002 |
| WO | 2012/133839 | A1 | 10/2012 |

OTHER PUBLICATIONS

Third Office Action dated Jan. 2, 2020 in Chinese Patent Application No. 201710754741.2 (with English translation).
Chinese Office Action dated Nov. 26, 2018 in Chinese Patent Application No. 201710754741.2 (with English translation).
Office Action dated Sep. 4, 2018 in Japanese Patent Application No. 2017-159573 (with English translation).
Office Action dated Mar. 7, 2018 in Korean Patent Application No. 10-2017-0009248 (with English translation).
Non-Final Office Action dated Feb. 25, 2019 in U.S. Appl. No. 15/677,923.
Non-Final Office Action dated Dec. 11, 2019 in U.S. Appl. No. 15/677,923.
Final Office Action dated Jul. 22, 2019 in U.S. Appl. No. 15/677,923.
Notice of Allowance dated Apr. 24, 2020 in U.S. Appl. No. 15/677,923.

* cited by examiner

INDUCTOR INCLUDING HIGH-RIGIDITY INSULATING LAYERS

CROSS-REFERENCE TO RELATED APPLICATION(S)

This application is a divisional of U.S. patent application Ser. No. 15/677,923 filed Aug. 15, 2017, now US Pat. No. 10,763,031, which claims the benefit of priority to Korean Patent Application Nos. 10-2016-0110571 filed on Aug. 30, 2016 and 10-2017-0009248 filed on Jan. 19, 2017 in the Korean Intellectual Property Office, the disclosures of each are incorporated herein by reference in their entirety.

TECHNICAL FIELD

The present disclosure relates to a surface mount device (SMD) type inductor used in a high frequency band of 100 MHz or more, and a method of manufacturing the same.

BACKGROUND

In accordance with the trend for slimness and lightness in electronic products, designs of electronic products have become complicated and fine, while the characteristics of elements of electronic products have also become complicated, such that complex technology is required in manufacturing the elements of electronic products.

It has become important for novel manufacturing methods, novel structures, improved performance and functionality to be applied to the elements of electronic products, while the cost and manufacturing time thereof are reduced.

Particularly, in accordance with the gradual miniaturization of elements, it has been required for a Young's modulus of such elements to be further improved.

Chip inductors are surface mount device (SMD) type inductor components mounted on circuit boards.

Thereamong, a high frequency inductor refers to a product having high frequency signals of 100 MHz or more applied thereto.

The high frequency inductor may be divided into a thin film type high frequency inductor, a winding type high frequency inductor, and a multilayer high frequency inductor. The thin film type high frequency inductor in which a coil is formed by a photolithography process using a photosensitive paste is advantageous for miniaturization.

The winding type high frequency inductor, manufactured by winding a coil wire, has a limitation in being applied to an element having a small size.

The multilayer high frequency inductor, manufactured by repeatedly performing a process of printing a paste on a sheet and stacking the sheet on which the paste is printed, is advantageous for miniaturization, but has relatively poor characteristics.

Recently, at the time of manufacturing a thin film type inductor, a method of manufacturing an inductor by forming coils with a semi-additive process (SAP) method using a substrate method and a substrate material and sequentially stacking insulating layers using build-up films has been known.

An inductor manufactured using the substrate method has lower rigidity than that of a chip manufactured using a ceramic dielectric, and a new method for improving the rigidity thereof is thus required.

SUMMARY

An aspect of the present disclosure may provide an inductor, particularly, a high frequency inductor.

As described above, the inductor manufactured by the substrate method according to the related art may have the lower rigidity than that of the chip manufactured using the ceramic dielectric.

An aspect of the present disclosure may also provide a thin film type inductor manufactured by a substrate method, a chip inductor having an excellent Young's modulus by replenishing insufficient rigidity, particularly, a high frequency chip inductor.

According to an aspect of the present disclosure, an inductor may include a body in which a coil formed by connecting a plurality of coil patterns to each other by vias is disposed and high-rigidity insulating layers, having high rigidity, are inserted into at least portions of upper and lower portions of the coil.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, an example of a method of manufacturing an inductor according to an exemplary embodiment in the present disclosure will be described. However, the present disclosure is not limited thereto.

FIGS. 1A through 1L are schematic cross-sectional views illustrating processes of a method of manufacturing an inductor according to an exemplary embodiment in the present disclosure.

Method of Manufacturing Inductor

According to an exemplary embodiment in the present disclosure, a method of manufacturing an inductor, including a body, in which a coil formed by connecting a plurality of coil patterns to each other by vias is disposed and cover layers having high rigidity are inserted into at least portions of upper and lower portions of the coil, may be provided.

The respective processes will hereinafter be described in detail.

1) Process of Preparing Base Substrate that is Separable/Detachable

Figure 1A:
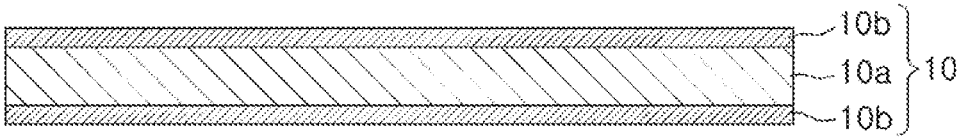
FIGS. 1A through 1L are schematic cross-sectional views illustrating processes of a method of manufacturing an inductor according to an exemplary embodiment in the present disclosure.

Referring to FIG. 1A, a base substrate 10 that is separable/detachable may be prepared. A central portion 10*a* of the base substrate 10 may be formed of a thermosetting resin, and seed copper (Cu) layers 10*b* of the base substrate 10 may be externally exposed.

Alternatively, a copper clad laminate (CCL) having a form in which carrier copper (Cu) having a thickness of 18 μm or more is included may be used as the central portion 10*a* of the base substrate 10.

Two laminates may be manufactured on opposite sides of the same base substrate 10 at the time of being manufactured, and after a process is completed, a copper foil having a thickness of 18 μm or more and a copper foil having a thickness of 2 to 5 μm may be separated from each other to prepare the two laminates.

2) Process of Manufacturing Dicing Key Pattern for Dicing

Figure 1B:
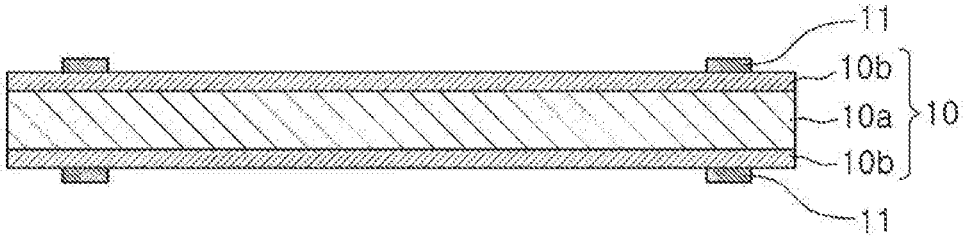

Referring to FIG. 1B, dicing key patterns 11 for dicing may be manufactured.

The dicing key patterns 11 defining diced positions at the time of dicing the laminate may be formed using a modified semi-additive process (MSAP).

Dry film resists (DFRs) may be laminated on the seed copper layers 10*b*, exposure, development and electro-plating may be performed to form the dicing key patterns 11, and the DFRs may be delaminated to implement the dicing key patterns 11 having a desired thickness and height.

Figure 1C:
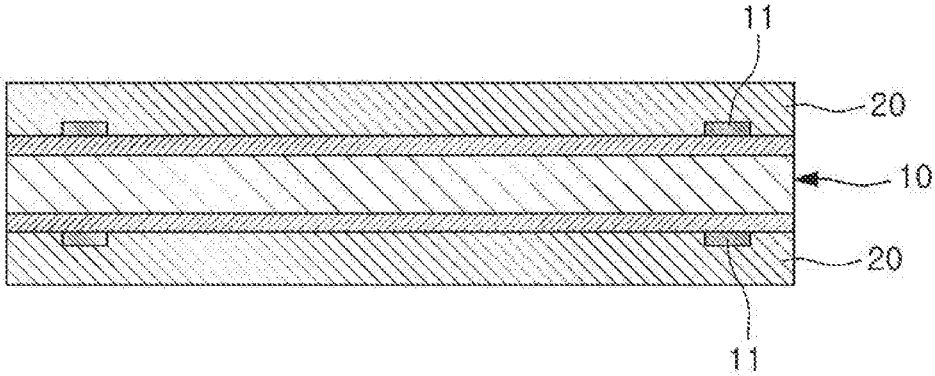

3) Process of Applying High-Rigidity Insulating Layer by Lamination Method and Hardening High-Rigidity Insulating Layer Referring to FIG. 1C, surfaces of the base substrate 10 on which the dicing key patterns 11 are formed may be pre-processed using Cz treatment to form roughness having a thickness of 0.1 to 2.0 μm on surfaces of the dicing key patterns formed of copper (Cu), and high-rigidity insulating materials, which are thermosetting materials or photosensitive materials having a thickness of 10 to 80 μm, may be applied to the surfaces of the base substrate 10 using a vacuum laminator to form high-rigidity insulating layers 20.

Then, a heat hardening process may be performed on the thermosetting materials in a convection oven, or a composite process of two or more processes such as an ultraviolet (UV) irradiation process, a heat hardening process using an oven, and the like, may be performed on the photosensitive materials.

As the high-rigidity insulating material, a material containing a metal or a ceramic filler may be used depending on the purpose.

In addition, a mixture of two or more kinds of thermosetting insulating materials and/or photosensitive insulating materials may also be used.

Meanwhile, according to another exemplary embodiment in the present disclosure, since close adhesion between the high-rigidity insulating material and copper formed by plating in a chemical solution is bad, after general build-up insulating materials are reapplied to the high-rigidity insulating layers 20 to form primer layers at a thickness of 3 to 10 μm, the process of applying the high-rigidity insulating layers by the lamination method and hardening the high-rigidity insulating layers, the process 3), may be repeated to form a circuit. The primer layers formed of build-up insulating materials may have a rigidity less than that of the high-rigidity insulating layers 20.

4) Process of Forming Roughness on Insulating Layer Through Desmearing

Figure 1D:
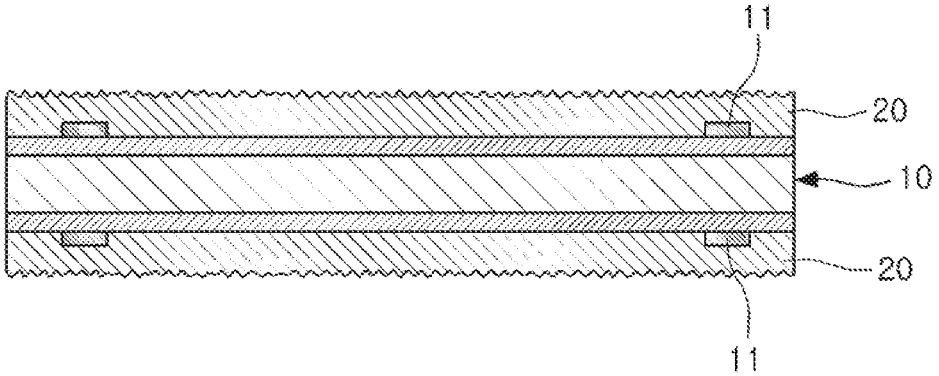

Referring to FIG. 1D, roughness having a thickness of 0.1 to 3.0 μm may be formed on surfaces of the high-rigidity insulating layers 20 or the primer layers by performing desmearing on a material on which the high-rigidity insulating layers 20 or the primer layers are formed.

5) Process of Forming Coil Pattern Using Semi-Additive Process (SAP)

Figure 1E:
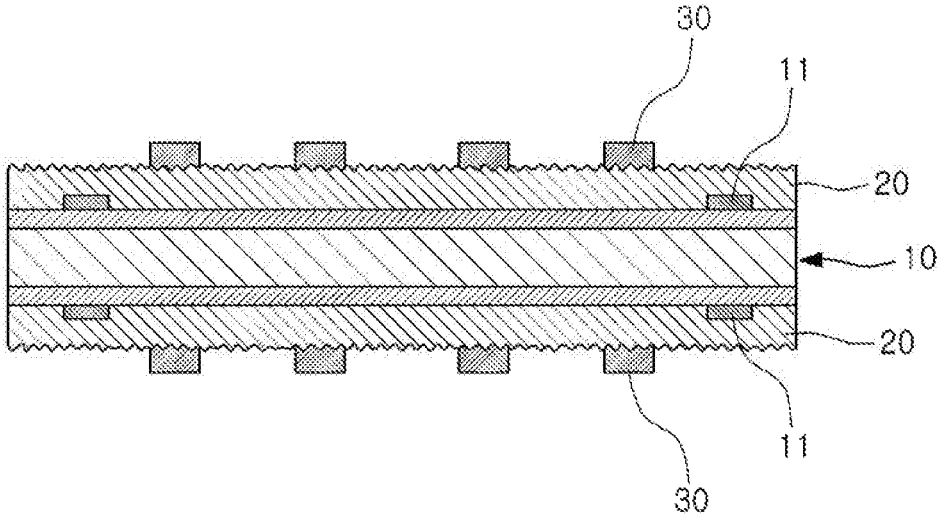

Referring to FIG. 1E, patterns may be formed using a semi-additive process (SAP). Copper plating layers may first be formed at a thickness of about 1 μm over entire surfaces of the material by plating in a chemical solution, dry films may be laminated, and coil patterns 30 may be formed through an exposing and developing process.

Then, a coil circuit may be formed in the patterns by electroplating, the dry films may be delaminated, and the copper plating layers formed by plating in a chemical solution remaining between the coil patterns 30 may be removed by flash etching to form coils on the high-rigidity insulating layers 20 or the primer layers.

6) Process of Forming Build-Up Insulating Layer on Coil Pattern

Figure 1F:
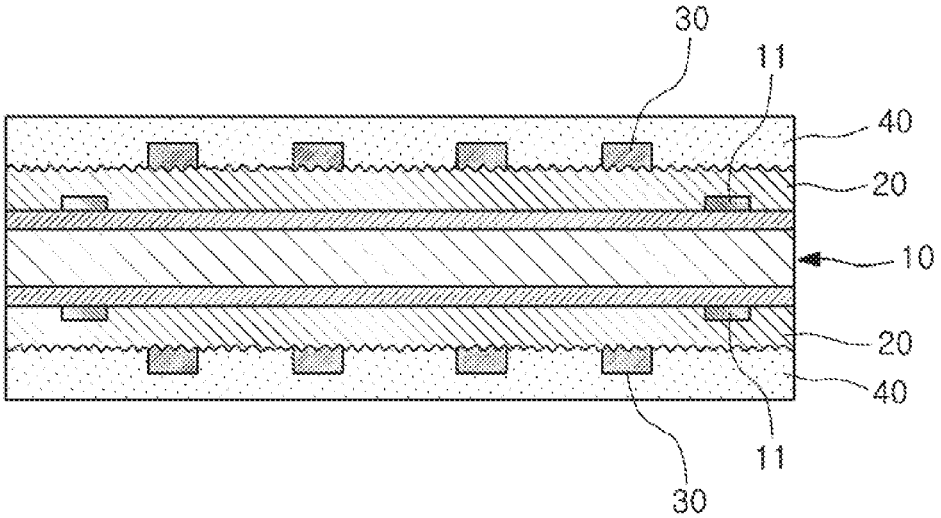

Referring to FIG. 1F, after the coil patterns 30 are formed, preprocessing may again be performed on the coil patterns 30 using Cz to form roughness on surfaces of the coil patterns 30 formed of Cu, and build-up insulating layers 40 may be applied to the high-rigidity insulating layers 20 on which the coil patterns 30 are formed, using a vacuum laminator. The build-up insulating layers 40 may have a rigidity less than that of the high-rigidity insulating layers 20.

Then, a heat hardening process may be performed on a thermosetting material or via patterns v that are to be developed through exposure may be formed in a photosensitive insulating material.

7) Process of Forming Via by Laser or Photolithography Process

Figure 1G:
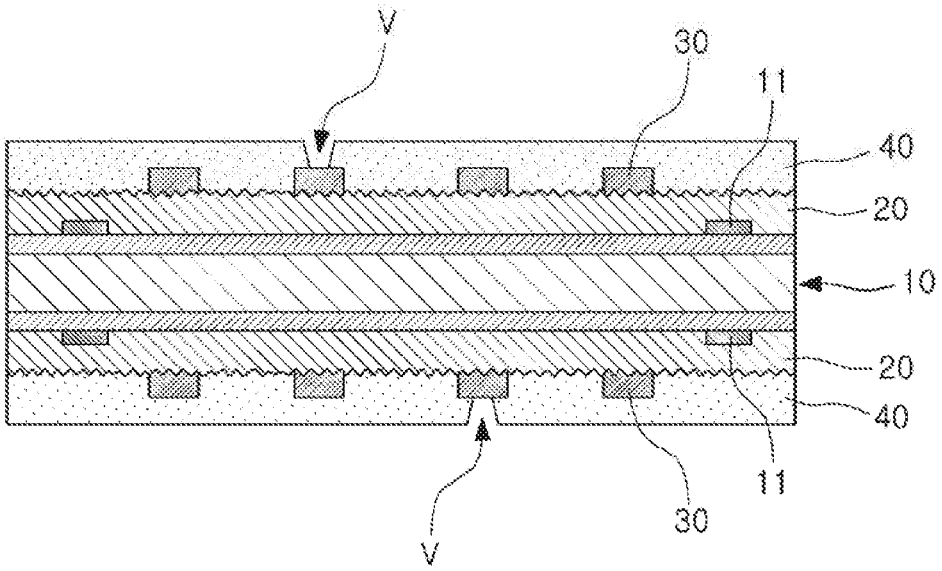

Referring to FIG. 1G, in a case in which the build-up insulating layers 40 are formed of a thermosetting material, vias V may be formed in the build-up insulating layers 40 using a $CO_2$ laser beam, and in a case in which the build-up insulating layers 40 are formed of a photosensitive material, vias V may be formed through development, and UV hardening, additional heat hardening, and the like, may then be performed on the photosensitive material to completely harden the photosensitive material.

8) Process of Desmearing Build-Up Insulating Layer

Figure 1H:
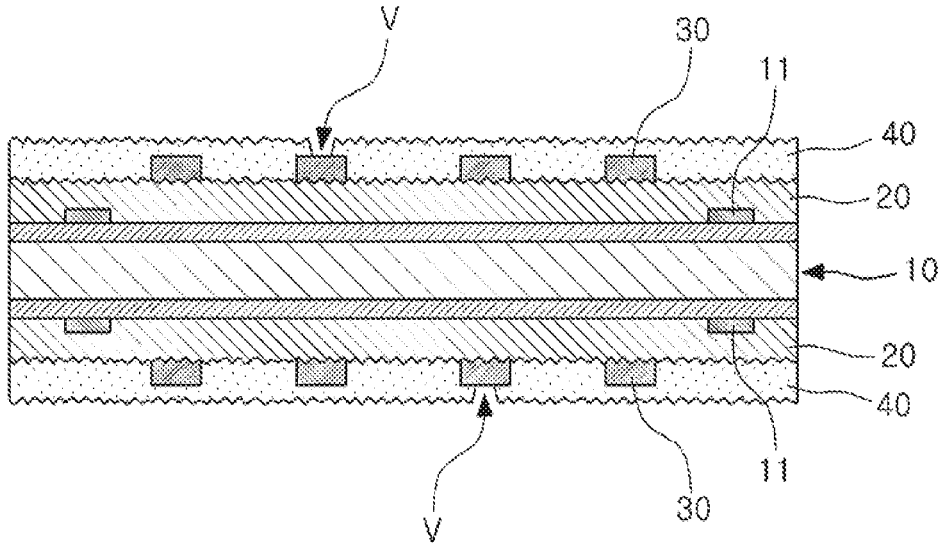

Referring to FIG. 1H, after the vias are formed, roughness may be formed on surfaces of the build-up insulating layers 40 in order to remove residues in the vias V and secure close adhesion of the copper formed by plating in a chemical solution, and a desmearing process may be performed in order to form the roughness on the surfaces of the build-up insulating layers 40.

9) Process of Forming Via and Coil Pattern Using Semi-Additive Process (SAP)

Figure 1I:
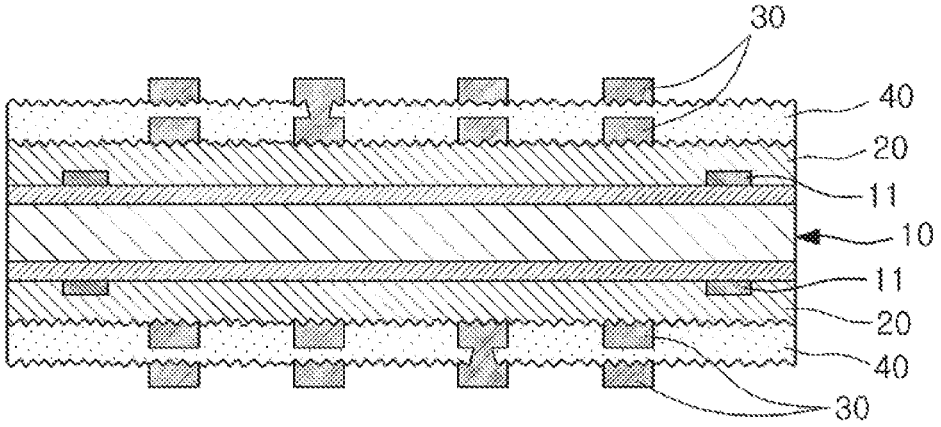

Referring to FIG. 1I, coil patterns 30 may be formed using a SAP as in the process 5), and vias v may then be formed.

Figure 1J:
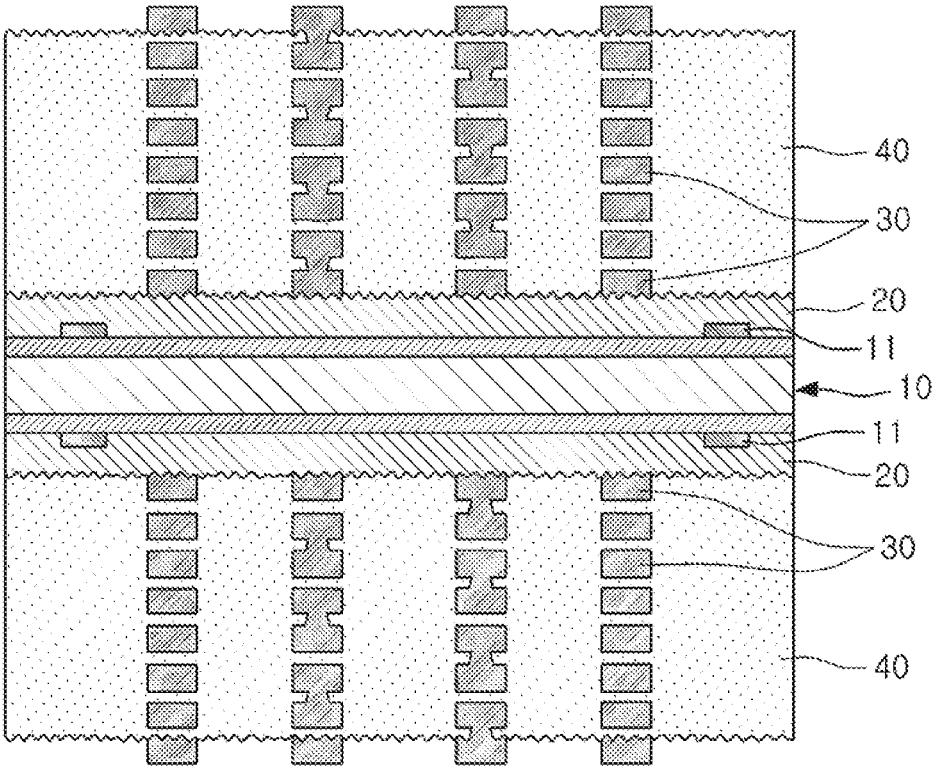

10) Process of Repeating Process 6) to Process 9) Until Number of Layers Becomes Desired Number of Layers Referring to FIG. 1J, the coil patterns 30 and the vias v may be formed through the process 6) to the process 9), and the process 6) to the process 9) may be repeatedly performed in order to obtain the coil patterns 30 and the vias v by the desired number of layers.

11) Process of Laminating High-Rigidity Insulating Material on Outermost Layer of Laminate Manufactured by Process 10)

Figure 1K:
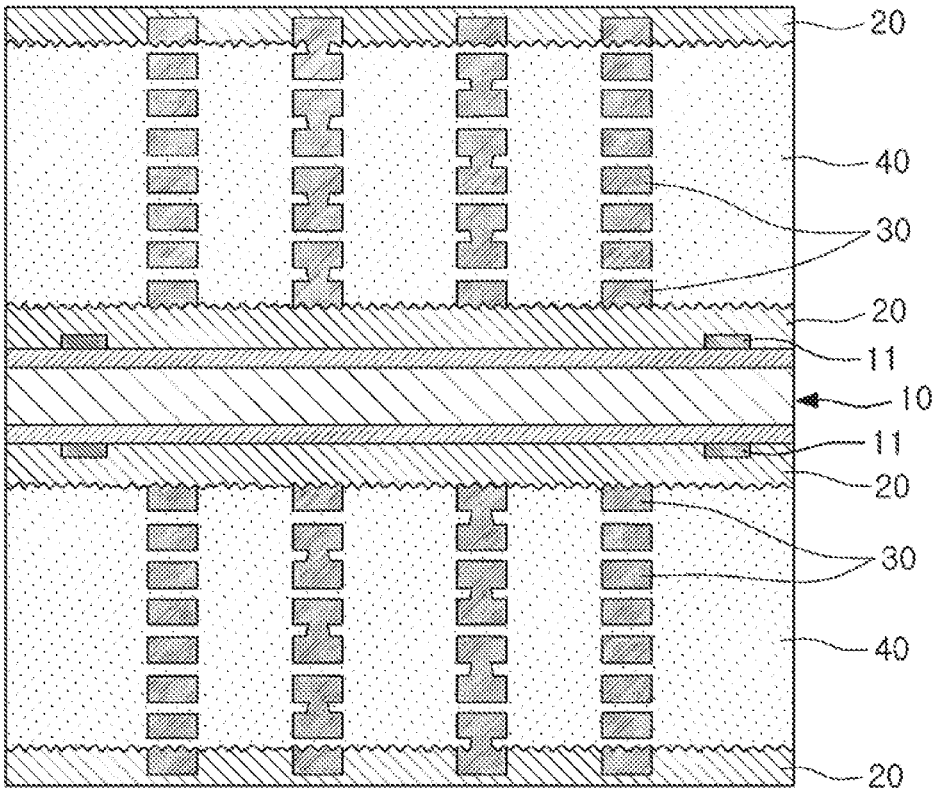

Referring to FIG. 1K, high-rigidity insulating materials may be laminated on the outermost layers of a laminate manufactured by the process 10) and may then be hardened to form high-rigidity insulating layers 20, and a sequential laminating process may be completed.

12) Process of Separating Sequentially Laminated Substrates from Base Substrate

Figure 1L:
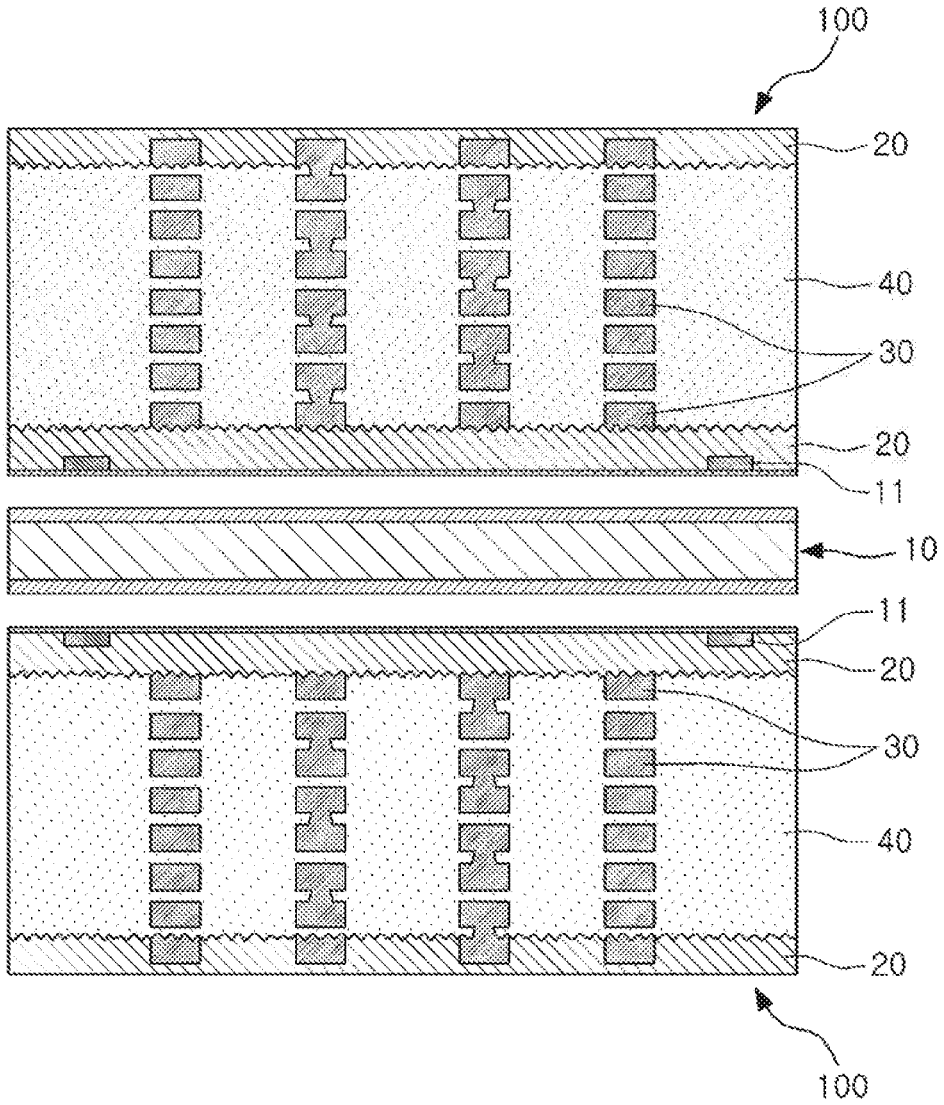

Referring to FIG. 1L, laminates 100 formed on upper and lower surfaces of the base substrate 10 may be separated from the base substrate 10, and a portion of the seed copper layers 10*b* remaining on the laminates 100 may be etched and removed.

Inductor

An inductor according to another exemplary embodiment in the present disclosure may include a body 100 including a coil layer and external electrodes (not illustrated) disposed on external surfaces of the body 100.

The body 100 of the inductor may be formed of a ceramic material such as glass ceramic, $Al_2O_3$, ferrite, or the like, but is not limited thereto. That is, the body 100 may also include an organic component.

The coil patterns 30 and the conductive vias v may be formed of silver (Ag) and/or copper (Cu).

Meanwhile, the coil patterns 30 may be disposed in a form parallel to a mounting surface of the inductor, but are not necessarily limited thereto.

Figure 2:
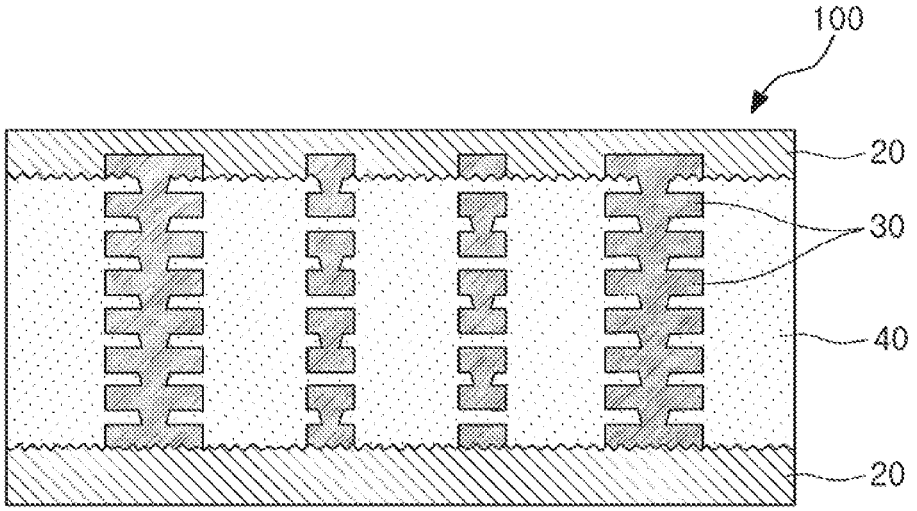
FIG. 2 is a schematic cross-sectional view illustrating an inductor according to an exemplary embodiment in the present disclosure.

FIG. 2 is a schematic cross-sectional view illustrating an inductor according to an exemplary embodiment in the present disclosure.

Referring to FIG. 2, the body may have a structure in which the coil patterns 30 and the high-rigidity insulating layers 20 are disposed, the total number of layers in the body may be two to twelve, and the coil patterns 30 of the body may be divided into coil parts and electrode parts.

The high-rigidity insulating layers 20 may further include fillers of which a content is 60 wt % to 90 wt %, may be manufactured using a thermosetting or photosensitive insulating film having a Young's modulus of 12 GPa or more, and may have a thickness of about 10 μm to 50 μm.

The coil patterns 30 may be covered with a thermosetting or photosensitive insulating material, and may have a structure in which circuits of the coil parts and the electrode parts are formed of copper (Cu).

Both of the coil part and the electrode part of each layer may exist or only one of the coil part and the electrode part of each layer may selective exist, depending on a design.

In an exemplary embodiment in the present disclosure, a Young's modulus of the build-up insulating layer 40 may be 80% or less of a Young's modulus of the high-rigidity insulating layer 20, for example, about 5 GPa, and a content of fillers in the build-up insulating layer 40 may be about 42 wt % or less.

Meanwhile, a Young's modulus of the high-rigidity insulating layers 20 disposed on and beneath the coil patterns 30 may be about 12 GPa such as about 7 GPa or more, and a content in fillers in the high-rigidity insulating layers 20 may be about 60 wt % to 90 wt %.

A board formed by stacking general organic materials has insufficient rigidity, and a board formed by stacking only high rigidity materials has good rigidity, but the board formed by stacking only the high rigidity materials is vulnerable to thermal impact due to a reduction in close adhesion between copper (Cu) and an insulating material, such that a problem may occur in reliability of the board.

According to the exemplary embodiment in the present disclosure, the high-rigidity insulating layers 20 having a high-rigidity material may only be introduced onto the outermost layers of a product to ensure desired strength and secure reliability of the product.

Figure 3:
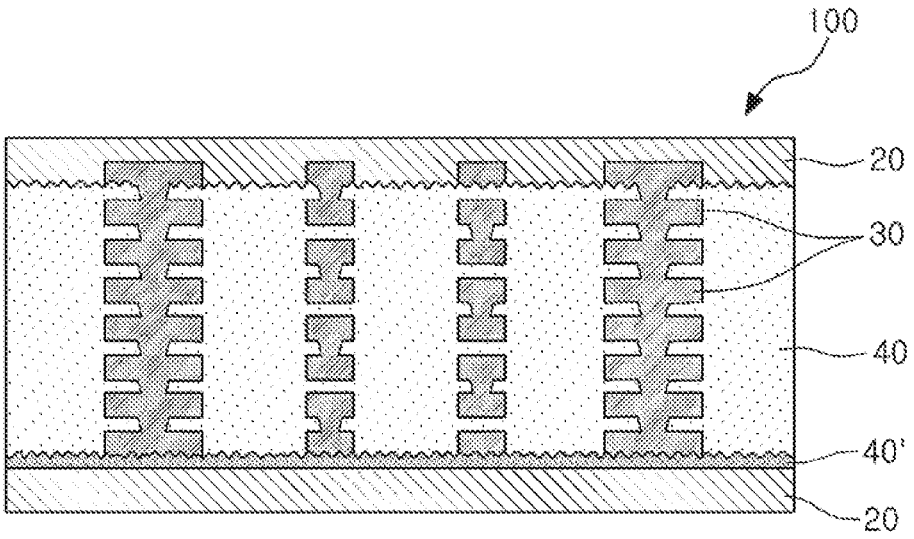
FIG. 3 is a schematic cross-sectional view illustrating an inductor according to another exemplary embodiment in the present disclosure.

FIG. 3 is a schematic cross-sectional view illustrating an inductor according to another exemplary embodiment in the present disclosure.

Referring to FIG. 3, the inductor according to another exemplary embodiment in the present disclosure may have a structure in which a build-up insulating material having excellent plating close adhesion is formed at a thickness of 3 to 20 μm on a lower high-rigidity insulating layer 20 to form a primer layer 40' and coil patterns 30 are formed on the primer layer 40', rather than directly forming the coil patterns on a surface of the lower high-rigidity insulating layer.

The primary layer 40' may be inserted as the build-up insulating material having the excellent plating close adhesion between the lower high-rigidity insulating layer 20 and the coil patterns 30, and close adhesion between the coil patterns 30 and the high-rigidity insulating layer 20 may thus be excellent.

As set forth above, the inductor according to the exemplary embodiment in the present disclosure may include the cover layers inserted into the body, formed on at least portions of the upper and lower portions of the coil, and having high rigidity to have a high Young's modulus.

While exemplary embodiments have been shown and described above, it will be apparent to those skilled in the art that modifications and variations could be made without departing from the scope of the present invention as defined by the appended claims.

What is claimed is:

1. An inductor comprising:

a body of the inductor including a plurality of coil layers, high-rigidity insulating layers disposed on and beneath the plurality of coil layers, and build-up insulating layers disposed between the high-rigidity insulating layers to cover the coil layers; and external electrodes disposed on external surfaces of the body and connected to the coil layers, wherein the high-rigidity insulating layers have a Young's modulus greater than that of the build-up insulating layers.

2. The inductor of claim 1, wherein the high-rigidity insulating layers have a Young's modulus of 7 GPa or more.

3. The inductor of claim 1, wherein the high-rigidity insulating layers respectively include fillers of which a content is 60 wt % to 90 wt % based on an entire content of the respective high-rigidity insulating layer.

4. The inductor of claim 1, wherein the build-up insulating layers have a Young's modulus equal to 80% or less of a Young's modulus of the high-rigidity insulating layers.

5. The inductor of claim 1, wherein an interface between the build-up insulating layers and at least one of the high-rigidity insulating layers includes a roughness.

* * * * *